US005253757A

United States Patent [19]

Locker

[11] Patent Number: 5,253,757

[45] Date of Patent: Oct. 19, 1993

[54] DRAWING RECEPTACLE FOR USE WITH COMPUTER PRINTERS

[75] Inventor: James S. Locker, Muncie, Ind.

[73] Assignee: Ball State University, Muncie, Ind.

[21] Appl. No.: 881,518

[22] Filed: May 12, 1992

[51] Int. Cl.[5] ..... B65H 31/14; A47B 63/00; B65D 1/34

[52] U.S. Cl. ..... 206/449; 206/555; 206/556; 312/183; 312/190; 271/219

[58] Field of Search ..... 312/183, 190; 206/449, 206/555, 556; 220/559; 271/215, 217, 219

[56] References Cited

U.S. PATENT DOCUMENTS

| | | | |
|---|---|---|---|
| 1,134,266 | 4/1915 | Hawkins | 312/183 |
| 1,362,310 | 12/1920 | Hiller et al. | 312/185 |
| 2,341,021 | 2/1944 | Curtis | 271/217 |
| 3,137,499 | 6/1964 | Maidment | 271/219 X |
| 3,907,281 | 9/1975 | McKenzie | 271/219 |
| 3,953,090 | 4/1976 | Fuchs | 206/556 |
| 4,310,160 | 1/1982 | Willette et al. | 271/219 X |
| 4,718,657 | 1/1988 | Otler et al. | 271/217 X |

FOREIGN PATENT DOCUMENTS

| | | | |
|---|---|---|---|
| 742403 | 5/1944 | Fed. Rep. of Germany | 312/183 |

*Primary Examiner*—William I. Price

*Attorney, Agent, or Firm*—Willian Brinks Olds Hofer Gilson & Lione

[57] ABSTRACT

A drawing receptacle can be adapted for use with the drawing output of such computer-directed printers, such as a laser printer. Such drawing receptacles can comprise a base, drawing retention means located about the base forming an open receptacle top and being adapted to retain drawings inserted into the open receptacle top, and a receptacle floor which is yieldably carried by the drawing receptacle above its base and within the drawing retention means and which is adapted to support drawing stacks of variable quantity.

10 Claims, 1 Drawing Sheet

DRAWING RECEPTACLE FOR USE WITH COMPUTER PRINTERS

FIELD OF THE INVENTION

This invention relates to a portable drawing receptacle adapted for use with computer printers, and more particularly relates to an inexpensive, portable receptacle adapted to receive and stack the output of a laser printer.

BACKGROUND OF THE INVENTION

Computers of the type frequently employed in CAD-systems can automatically generate entire sets of drawings of complex machines and assemblies, including overall assembly drawings, sub-assembly drawings, parts drawings and parts lists in varied sizes and deliver from a printer output individual drawings of such assemblies and parts in appropriate varied sizes and in any pre-programmed order. Because of the volume of such drawings producible with computer-directed printers and the rate at which such drawings are produced, computer printers have, in the past, been attended by personnel who receive the drawings from the printer output, maintain the pre-programmed collation and ensure that the drawings are properly stacked. It is common in large manufacturing facilities that their engineering and manufacturing departments have a number of such computer-directed printers operating simultaneously to output vast quantities of engineering drawings.

In the past, there has been no inexpensive receptacle which can receive the vast quantity, literally hundreds, of drawings that may be outputted from a computer-directed printer, such as a laser printer, by automatically stacking the drawings and maintaining the pre-programmed order in which they are generated by the computer and which can be moved and used with a number of printers at different locations.

SUMMARY OF THE INVENTION

This invention provides a drawing receptacle adapted for use with the drawing output of a computer-directed printer, such as a laser printer. Drawing receptacles of the invention comprise a base, drawing retention means located about the base forming an open receptacle top and being adapted to retain drawings inserted into the open receptacle top, and a receptacle floor which is yieldably carried by the drawing receptacle above its base and within the drawing retention means and which is adapted to support drawing stacks of variable quantity. Such drawing receptacles can include drawing retention means comprising four walls carried about the periphery of a rectangular base, with one of the walls being adapted for location adjacent the output of the printer and including a sloping portion of adjustable height adapted for positioning adjacent the printer output to direct drawings leaving the printer output onto the receptacle floor. In such drawing receptacles, one of the other walls, preferably the wall opposite the wall to be located adjacent the printer output, includes a large opening extending from the open top to adjacent the base to permit air to be expelled from between the receptacle floor and the base and to permit the drawings to be grasped easily by a user for removal.

In one embodiment of the drawing receptacle, a plurality of compression springs are supported by the base, and the receptacle floor is carried by the plurality of compression springs. In supporting the plurality of compression springs, the base carries a plurality of vertically extending rods in a plurality of recesses formed in the walls of the receptacle, and each of the plurality of compression springs extends around and is located by one of the vertically extending rods. The receptacle floor includes means forming a plurality of openings through which the rods extend and which engage the top of the compression springs, which yieldably support the receptacle floor from the base and compress in response to the weight of the drawings received from the printer to support the drawings within the receptacle but adjacent its open top. Where convenient, the drawing receptacle may be provided with a plurality of casters and with a removable handle permitting its relocation from one printer location to another.

Other features and advantages of the invention will be apparent from the drawings and more detailed description that follows.

BEST MODE OF THE INVENTION

While the drawings and the description that follow show and describe a printing receptacle manufactured from such commonly available materials as plywood or fiberboard with commonly available hardware, it will be apparent to those skilled in the art that drawing receptacles of the invention may be manufactured from steel components which are welded or fastened together into a drawing receptacle assembly, or from molded plastic components which may be fastened together. Thus, a preferred embodiment or best mode of the invention will be one most economically manufactured to provide durability and reliable operation in keeping with the invention as described below, and various other constructions and embodiments of the invention will be apparent to those skilled in the art.

Figure 1:
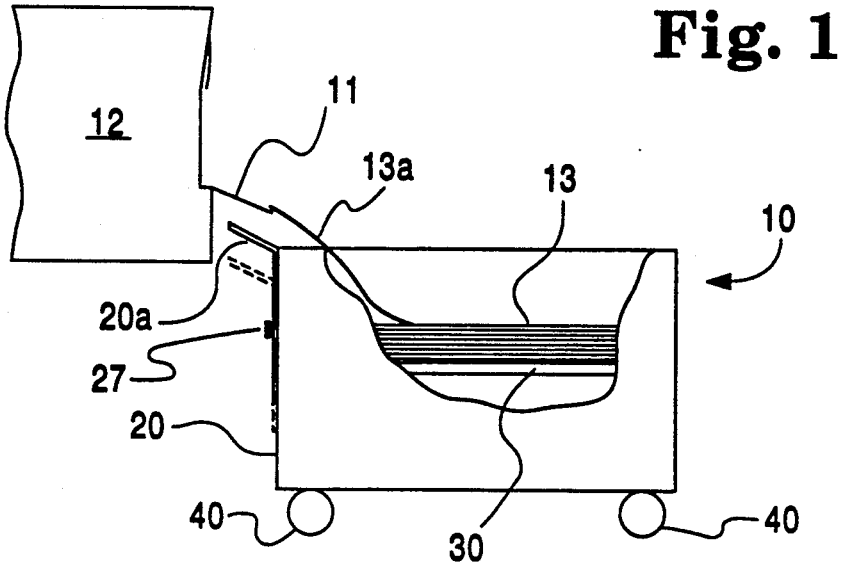
FIG. 1 is a diagrammatic illustration of a drawing receptacle of this invention, which has a side wall partially broken away to show a portion of its interior, in use adjacent the output of a computer-directed printer.

As shown in FIG. 1, a drawing receptacle of the invention 10 is located adjacent the output 11 of a computer-directed printer 12, such as a laser printer. As shown in FIG. 1, one of the side walls 20 of the drawing receptacle is adapted for location adjacent the output of the printer. Side wall 20 comprises, in part, a sloping portion 20*a* of adjustable height which may be positioned adjacent the output 11 of the printer 12 to ensure that drawings leaving the printer output 11 are directed to the floor 30 of the drawing receptacle. As indicated in FIG. 1, the drawings 13*a* leaving the output 11 of the printer 12 are received on the receptacle floor 30 and stacked in the order in which they are received, as indicated generally by the numeral 13. To ensure that the drawings 13*a* are directed into the drawing receptacle 10, the sloping end portion 20*a* may be adjusted upwardly to be located adjacent and immediately below the output 11 of the printer 12 by loosening one or more fasteners 27 in end wall 20 and adjusting the sloping portion 20*a* upwardly from a position indicated in dashed lines to a position like that shown in FIG. 1. As further indicated in FIG. 1, the drawing receptacle 11 may include a plurality of casters 40 to permit it to be rolled from printer to printer.

Figure 2:
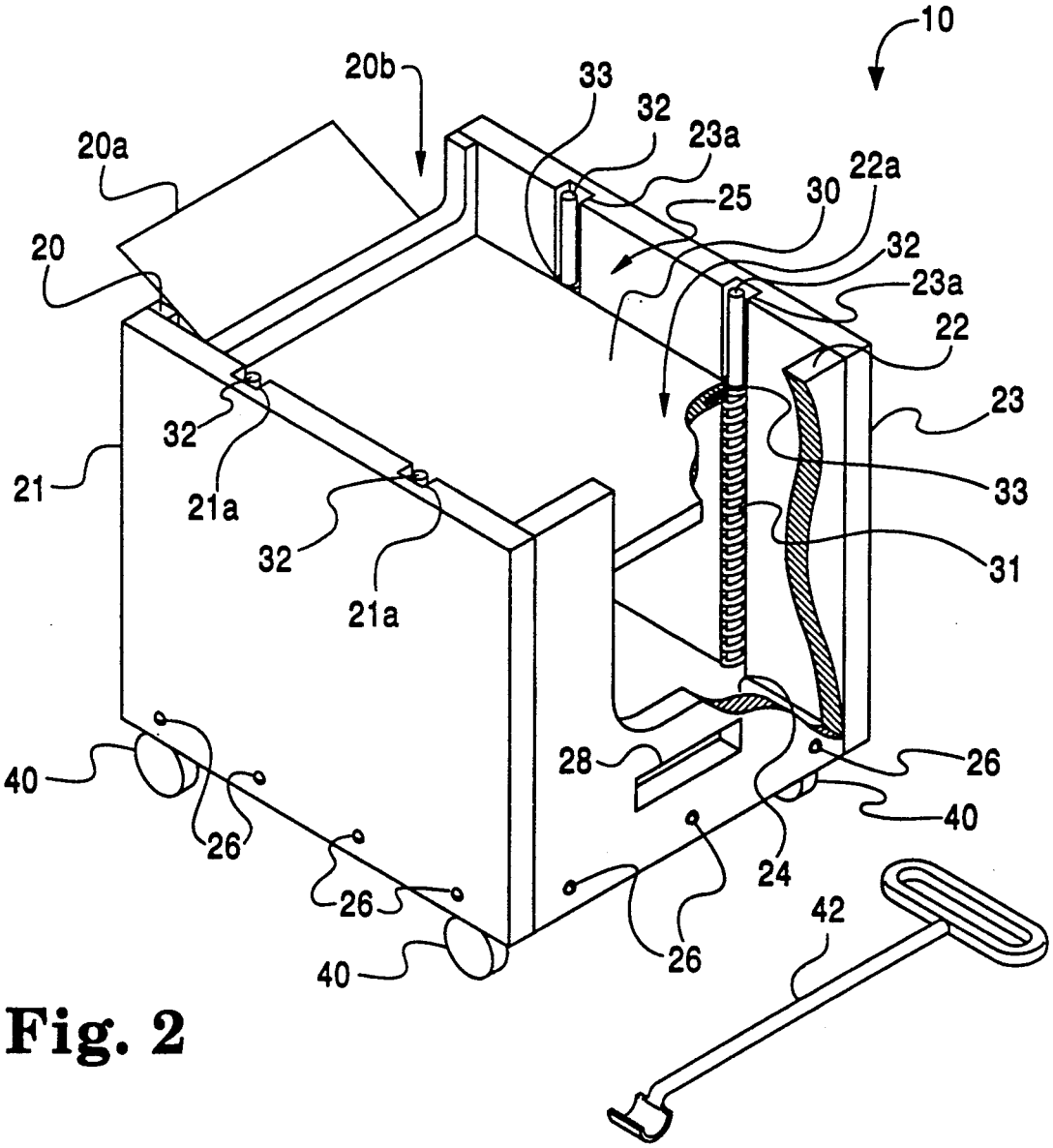
FIG. 2 is a perspective view of a drawing receptacle of the invention with portions of the side and the receptacle floor partially broken away to show its interior construction.

An inexpensive drawing receptacle which may be constructed from materials commonly available at lumber yards and hardware stores is shown in FIG. 2. The embodiment shown in FIG. 2, for example, may be constructed with plywood or with fiberboard having a thickness, for example, of about ¾ to 1 inch or more, with steel rod stock having a diameter on the order of 3/16 to ¼ inch, with a plurality of steel eyelets with threaded extensions, with a plurality of wood screws, and with aluminum or steel sheetmetal having a thickness of 1/16 to ⅛ inch in diameter (and, if desired, with a plurality of casters).

As shown in FIG. 2, a drawing receptacle includes a rectangular base 24, a receptacle floor 30 yieldably carried by the drawing receptacle 10 above the base 24 and drawing retention means 20–23 located about the base 24 forming an open receptacle top (indicated by arrow 25) and adapted to retain drawings inserted into the open receptacle top 25. As indicated in FIGS. 1 and 2, the receptacle floor 30 is yieldably carried by the drawing receptacle within the drawing retention means 20–23 and is adapted to support drawing stacks of variable quantity in a manner to be described below.

As shown in FIG. 1, the drawing retention means comprises four walls 20, 21, 22, 23, carried about the periphery of the base by, for example, a plurality of screws 26 which fasten the four walls to each other and to the base 24. While the retention means 20, 21, 22, 23, as shown in FIG. 2, comprise plywood or fiberboard having a thickness of on the order of 1 inch, the retention means can comprise molded plastic wall sections extending along each side of the base, or a plurality of rods or straps extending vertically from the base adjacent its edges to form an open structure, or wall sections of expanded metal, or any of a number of other forms to provide surfaces to be engaged by the drawings 13 leaving a printer 12 as indicated in FIG. 1 to retain the drawings within the drawing receptacle, stacked in the order in which they are expelled from the printer 12.

As indicated in FIG. 2, the side wall 20 adapted for location adjacent the output of the printer may be provided with a cut-away portion 20*b* to cooperate with the adjustable sloping portion 20*a* whose height may be adjusted by one or more fastening means, such as the wing nut 27 shown in FIG. 1. It should be understood, however, that while FIG. 1 shows a wing nut to hold the sloping portion 20*a* in its adjusted position, any convenient fastener can be used for this purpose such as toggle bolts, lever-operated cams, screws or any other such fastener.

As shown in FIG. 2, one of the walls of the drawing receptacle includes a large opening 22*a* which preferably extends from the open top 25 to adjacent the base 24. The opening 22*a*, which is preferably a rectangular slot extending from the open top 25 to adjacent the base 24 in the end wall 22 opposite end 20, permits air to be expelled from between the receptacle floor 30 and the base 24 as drawings are added to the drawing receptacle 10 and permits a user to reach through the opening 22*a* and grasp stacks of drawings 13 by their edges for removal from the open top 20 of the receptacle.

As shown in FIG. 2, the receptacle floor 30 is yieldably carried by a plurality of compression springs 31 supported at their bottoms by the base 24. Compression springs 31 may, as is well known in the art, be manufactured to compress in response to the weight of the drawings 13 at a rate selected to maintain the stack of drawings 13 a few inches below the open top 25 of the drawing receptacle.

In the construction of the drawing receptacle 10 shown in FIG. 2, the base 24 carries a plurality of vertically extending rods 32 which are located adjacent walls 21 and 23. The plurality of rods 32 are located within recesses 21*a* and 23*a* formed in walls 21 and 23 so that they do not interfere with the drawings 13 being received in the drawing receptacle 10. The plurality of vertically extending rods 32 extend within and locate compression springs 31 within the recesses 21*a* and 23*a* of walls 21 and 23, respectively.

The receptacle floor 30 includes means 33 forming a plurality of openings through which the rods 32 extend. The opening forming means 33 engaged the top of compression springs 31 which thus provide the yieldable support for receptacle floor 30. As shown in FIG. 2, each of the opening-forming means is preferably an eyelet threaded into the sides of the receptacle floor 30 so that it extends from the edge of the receptacle floor 30, into the recesses 21*a* and 23*a* of walls 21 and 23 and around one of the vertically extending rods 32.

While the yieldable means supporting receptacle floor 30 in the construction shown in FIG. 2 comprises compression springs 31 below the receptacle floor adjacent the walls forming the drawing retention means, such yieldable means could comprise tension springs carrying the yieldable floor 30 from adjacent the open top 25 of the drawing retention means 20–23, compression springs centrally located on the base 24 below the floor 30, or other such means providing variation in the distance between the receptacle floor 30 and the open top 25 of the drawing receptacle.

As indicated and discussed above, the drawing receptacle of FIG. 2 may be provided with a plurality of casters 40 to permit its relocation from one printer location to another printer location. In addition, one of the walls 20 or 22 may be provided with an opening 28, which may engage a long handle 42 to permit the drawing receptacle 20 to be conveniently pulled from location to location.

Receptacles of the invention may be provided in varied sizes to accommodate varied size printouts, such as the sprocket driven "green and white bar" output of printers for mainframe computers and the 8½×11 inch output of personal computers. Other variations of the invention will be apparent such as providing ease of disassembly through the use of pins projecting upwardly from the receptacle base 24 to engage cooperatively located bores in the bottom of the walled retention means that, unlike that shown in FIG. 2, sets upon receptacle base 24. Such pin-bore engagement permits the walled receptacle means to be lifted upwardly from the base for access to the compression springs and space between the base and receptacle floor.

While the drawings and description above present a drawing receptacle embodiment that may be easily and inexpensively manufactured from commonly available construction materials and hardware, other embodiments of the invention will become apparent to those skilled in the art and the invention is to be limited only by the scope of the following claims and the prior art.

I claim:

1. A drawing receptacle adapted for use with an output of a printer, comprising:

a rectangular base;

drawing retention means located about said base, forming an open receptacle top and being adapted to retain drawings inserted into the open receptacle top;

a plurality of compression springs supported at their bottoms by said base;

a plurality of vertically extending rods carried by said base, said plurality of rods extending within and locating said compression springs adjacent said drawing retention means; and a receptacle floor yieldably carried by said compression springs above said base and within said drawing retention means and adapted to support drawing stacks of variable quantity, said compression springs being located between said base and said receptacle floor, said receptacle floor including means forming a plurality of openings through which said rods extend so that said compression springs engage the receptacle floor.

2. The drawing receptacle of claim 1 wherein each of said plurality of vertically extending rods is carried within a recess formed in the adjacent wall and each of said means forming a plurality of openings comprises an eyelet extending from an edge of said receptacle floor into one of the wall recesses and around one of the vertically extending rods.

3. A drawing receptacle adapted for use with an output of a printer, comprising:

a rectangular base;

drawing retention means having four walls carried about the periphery of the base, said walls forming an open receptacle top and being adapted to retain drawings inserted into the open receptacle top; and a receptacle floor yieldably carried by said drawing receptacle above said base and within said drawing retention means and adapted to support drawing stacks of variable quantity, one of said walls being adapted for location adjacent the output of the printer and comprising, in part, a sloping portion adjustable in height for positioning adjacent the output to direct drawings leaving the printer output onto the receptacle floor.

4. The drawing receptacle of claim 3 wherein one of the other walls includes a large opening extending to adjacent the base to permit air to be expelled from between the receptacle floor and the base and to permit the drawings to be grasped easily for removal by a user.

5. The drawing receptacle of claim 4 wherein the opening comprises a rectangular slot extending from the open top of the receptacle located in the end wall opposite the end adapted for location adjacent the printer.

6. The drawing receptacle of claim 3 wherein the base carries a plurality of compression springs and wherein said receptacle floor is carried by said plurality of compression springs.

7. The drawing receptacle of claim 6 wherein said base carries a plurality of vertically extending rods adjacent the walls, and said plurality of rods extend within and locate said compression springs adjacent the walls of the drawing receptacle, and wherein said receptacle floor includes means forming a plurality of openings through which said rods extend and which engage the top of said compression springs.

8. The drawing receptacle of claim 7 wherein each of said plurality of vertically extending rods is carried within a recess formed in the adjacent wall and each of said means forming a plurality of openings comprises an eyelet extending from an edge of said receptacle floor into one of the wall recesses and around one of the vertically extending rods.

9. The drawing receptacle of claim 5 wherein said base is supported on a plurality of casters, permitting its relocation from one printer location to others.

10. The drawing receptacle of claim 9 further comprising a removable handle adapted to engage the drawing receptacle.

* * * * *